US005465580A

United States Patent [19]

Kwon

[11] Patent Number: 5,465,580

[45] Date of Patent: Nov. 14, 1995

[54] COOLING AND HEATING WATER CIRCULATION APPARATUS OF VUILLEUMIER HEAT PUMP

[75] Inventor: Yong-Rak Kwon, Seoul, Rep. of Korea

[73] Assignee: Samsung Electronics Co., Ltd., Suwon, Rep. of Korea

[21] Appl. No.: 230,790

[22] Filed: Apr. 21, 1994

[30] Foreign Application Priority Data

Apr. 30, 1993 [KR] Rep. of Korea ..... 1993-7576

[51] Int. Cl.[6] ..... F25B 9/00

[52] U.S. Cl. ..... 62/6; 60/648

[58] Field of Search ..... 62/6; 60/648

[56] References Cited

U.S. PATENT DOCUMENTS 3,892,102 7/1975 Leo ..... 62/6
4,249,378 2/1981 Benson ..... 62/6
4,435,959 3/1984 Mohr ..... 62/6
4,514,979 5/1985 Mohr ..... 62/6
4,969,333 11/1990 Osawa et al. ..... 62/6
5,056,316 10/1991 Chung ..... 62/6

*Primary Examiner*—Ronald C. Capossela
*Attorney, Agent, or Firm*—Burns, Doane, Swecker & Mathis

[57] ABSTRACT

A Vuilleumier heat pump comprises a high temperature section and a low temperature section. The high temperature section includes a high temperature chamber heated by a combustion unit, and a high temperature heat exchanger. The low temperature heat section includes a low temperature chamber and a low temperature heat exchanger. During a room-cooling mode, the high and low temperature heat exchangers are connected to outdoor and indoor heat exchangers, respectively. During a room-heating mode, the high temperature heat exchanger is connected to the indoor heat exchanger, and the low temperature heat exchanger is connected to an auxiliary heat exchanger which transmits heat from the combustion unit to the low temperature heat exchanger.

6 Claims, 2 Drawing Sheets

COOLING AND HEATING WATER CIRCULATION APPARATUS OF VUILLEUMIER HEAT PUMP

BACKGROUND OF THE INVENTION

1. Field of the Invention

The present invention relates to a cooling and heating water circulation apparatus of a Vuilleumier heat pump for allowing a low temperature heat exchanger to absorb heat from a combustion unit during heating to thereby maintain a predetermined Coefficient of a Performance (COP) regardless of variations in outdoor temperatures, so that heating efficiency can be improved.

2. Description of Prior Art

Generally, the Vuilleumier heat pump comprises cylinders having three spaces of respectively different temperatures, the spaces being filled with gases such as helium, hydrogen or the like in high pressure, and the cylinders being provided with a high-temperature displacer and a low temperature displacer moving back and forth with a predetermined phase difference therein. The displacers shift the gases within a predetermined cycle to thereby cause pressure changes of gases according to the temperature changes, so that cooling and heating can be accomplished by way of heat discharge produced from the gases and heat absorption from the gases.

FIG. 1 is one embodiment of a cooling and heating water circulation apparatus of a conventional Vuilleumier heat pump.

According to FIG. 1, the Vuilleumier heat pump is disposed with a perpendicularly-related high temperature cylinder 2 and a low temperature cylinder 3 and a driving chamber 100 at which the two cylinders 2 and 3 meet.

The two cylinders 2 and 3 are filled with such gases as helium, hydrogen or the like in high pressure.

The high temperature cylinder 2 and the low temperature cylinder 3 are provided with a high temperature displacer 202 and a low temperature displacer 302 respectively, thereby separating the high temperature cylinder 2 into a high temperature chamber 200 and a mid temperature chamber 201, and separating the low temperature cylinder 2 into a mid temperature chamber 301 and a low temperature chamber 300.

The driving chamber 100 is provided with a motor 110, an axis of which is fixed with a crank shaft 120.

The crank shaft 120 is connected to the two displacers 202 and 302 through connecting rods 203 and 303.

Accordingly, when the motor 110 rotates, the crank shaft 120 in turn rotates and according to the rotation of the crank shaft 120, the connecting rods 203 and 303 perform a linear motion to thereby move back and forth the high and low temperature displacers 202 and 302.

At this time, the high and low temperature displacers 202 and 302 maintain a predetermined phase difference therebetween and move back and forth.

In other words, the two displacers 202 and 302 move reciprocatively in opposite directions relative to each other.

Meanwhile, a high temperature heat regenerative means comprising a high temperature heat regenerator 220 and a mid temperature heat exchanger 230 is disposed between the high temperature chamber 200 and the mid temperature chamber 201 on the high temperature side or section of the heat pump.

A low temperature heat regenerative means comprising a low temperature regenerator 320, a mid temperature heat exchanger 330 and a low temperature heat exchanger 310 is disposed between the mid temperature chamber 301 on the low temperature side and the low temperature chamber 300.

The high temperature heat regenerator 220 and the low temperature heat regenerator 32 are inter-connected, through a connecting tube, and the high temperature chamber 200 and the high temperature heat regenerator are interconnected by a high temperature heat exchanger 210.

The high temperature heat exchanger 210 passes through a combustion chamber 400 in a combustion unit 4, wherein gas passing through the high temperature heat exchanger 210 is heated by a burner 410.

The gas in the cylinders 2 and 3 is moved by a reciprocating motion of the high temperature displacer 202 in order of the high temperature chamber 200→high temperature heat exchanger 210→high temperature regenerator 220→mid temperature heat exchanger 230 on the high temperature side→mid temperature chamber 201 on the high temperature side, and then is moved in turn in order of mid temperature chamber 201 on the high temperature side→mid temperature heat exchanger 230 on the high temperature side→high temperature regenerator 220→high temperature heat exchanger 210→high temperature chamber 200.

According to a reciprocating motion of the low temperature displacer 302, the gas is moved in order of the mid temperature chamber 301 on the low temperature side→ mid temperature heat exchanger 330 on the low temperature side→low temperature regenerator 320→low temperature heat exchanger 310→low temperature chamber 300, and then is moved in turn in order of the low temperature chamber 300→low temperature heat exchanger 310→low temperature regenerator 320→mid temperature heat exchanger 330 on the low temperature side→mid temperature chamber 301 on the low temperature side.

Here, the high temperature regenerator 220 extracts the heat from the gas moving from the high temperature chamber 200 to the mid temperature chamber 201 on the high temperature side to accumulate the heat, and then pre-heat the gas moving from the mid temperature chamber 201 on the high temperature side to the high temperature chamber 200.

The low temperature regenerator 320 accumulates the heat of the gas moving from the mid temperature chamber 300 on the low temperature chamber to the low temperature chamber 300 and then pre-heats the gas moving from the low temperature chamber 300 to the mid temperature chamber 301 on the low temperature side.

A conventional cooling and heating water circulation apparatus for cooling and heating indoors by way of the Vuilleumier heat pump comprises four-way valves FV1 and FV2, an indoor heat exchanger 6 and a convection fan F1 disposed indoors, an outdoor heat exchanger 7 and a cooling fan F2 disposed outdoors, a cooling water pipe CL penetrating an inner part of the low temperature heat exchanger 310, a heating water pipe HE penetrating inner parts of the mid temperature heat exchangers 230, 330, an indoor connecting water pipe L1 and circulation pump P2 of the indoor heat exchanger 6, and an outdoor connecting water pipe L2 and a circulation pump P1 of the outdoor heat exchanger 7, so that the cooling and heating water can be circulated to respective indoor and outdoor heat exchangers 6 and 7.

In other words, for the cooling operation, the four-way valves FV1 and FV2 are operated (driven) to interconnect the cooling water pipe CL and the indoor connection water pipe L1 and to interconnect the heating water pipe HL and the outdoor connecting water pipe L2.

At this time, the cooling water cooled in the process of passing through the low temperature heat exchanger 310 has cooled the room interior in the course of its circulation to the indoor heat exchanger 6, and the heating water heated (or heat-absorbed) in the process of passing through the mid temperature heat exchangers 230, 330 discharges the heat in the course of its circulation through the outdoor heat exchanger 7.

Meanwhile, for the heating operation, the four-way valves FV1 and FV2 are operated (driven) to interconnect the cooling water pipe CL and the outdoor connecting water pipe L2 and to interconnect the heating water pipe HL and the indoor connecting pipe L1.

At this time, the heating water heated (or heat-absorbed) in the process of passing through the mid temperature heat exchangers is circulated to the indoor heat exchanger 6 to heat the room interior, and the cooling water which has passed through the low temperature heat exchanger 310 is circulated to the outdoor heat exchanger 7 to thereby absorb heat.

However, in the above description, the heating is usually executed during the winter time, and during this time, because the outdoor temperature is very low and the heat absorbed by the outdoor heat exchanger 7 is insufficient, the quantity of heat at the low temperature heat exchanger 310 is relatively reduced.

Because of the insufficiency of heat absorbed at the outdoor heat exchanger 7 to thereby allow the cooling water of low temperature to be circulated to the low temperature heat exchanger 310, the temperature at the low temperature chamber 300 drops, thereby reducing a heating Coefficient of Performance COP, which can be explained in the following formula.

$$COPc=(TH-TA/TH)\ (TC/TA-TC) \qquad \text{Formula 1}$$

$$COPh=1+COPc \qquad \text{Formula 2}$$

Where, COPc=cooling COP, COPh=heating COP, TH=temperature at the high temperature chamber 200, TA= temperatures of mid temperature chambers 201, 301, and TC=temperature at the low temperature chamber 300, and the temperatures mentioned in the above formulae denote the absolute temperatures.

As seen in the formula 1, it should be apparent that when the temperature TC of the low temperature chamber 300 drops, the cooling COP (COPc) is reduced, and when the cooling COP (COPc) is reduced, the heating COP (COPh) is also reduced.

In other words, there has been conventionally a drawback in that the temperature TC at the low temperature chamber 300 drops due to the low outdoor temperature under weather calling for substantially greater heating load to thereby cause the heating COP (COPh) to deteriorate.

Meanwhile, for example, in Japanese laid open patent application No Hei 4 (1992) - 113175 entitled, "Heating device", an auxiliary heating device is provided which comprises an externally fired engine driven by heat from a combustor. A medium heated by a radiating heat exchanger of the externally fired engine flows, to the indoor heat exchanger. An exhaust heat retrieving heat exchanger for retrieving exhaust heat from the combustor is disposed on a pipe which conducts the medium from the radiating heat exchanger to the indoor heat exchanger.

According to the Japanese laid open patent application No. Hei 4 (1992) - 113175, the heated medium discharged from the radiating heat exchanger is reheated in the exhaust heat retrieving heat exchanger before being introduced into the indoor heat exchanger, so that heating capacity is improved and at the same time, a high exhaust heat retrieving efficiency is achieved due to the presence of the exhaust heat retrieving heat exchanger.

In other words, as described, when the input heat is assumed as having a value of 100, and discharged heat is assumed as having a value of 20, the heat retrieved from the discharged heat can have a value 6.

However, the aforesaid apparatus has a drawback in that the retrieval of exhaust heat from the combustor for directly supplying the same to the indoor heat exchanger for use not only achieves less retrieval efficiency of the waste heat but also contributes absolutely no effect on improving the efficiency of the Vuilleumier heat pump.

SUMMARY OF THE INVENTION

It is, therefore, an object of the present invention to overcome the aforementioned disadvantages, and it is an object of the present invention to provide a cooling and heating water circulation apparatus of a Vuilleumier heat pump which can maintain the temperature of a low temperature chamber thereof at a predetermined constant degree to thereby prevent the heating COP from dropping, so that the heating efficiency can be improved during the heating mode.

In order to attain the aforesaid object according to the present invention, there is provided a cooling and heating water circulation apparatus of Vuilleumier heat pump which allows cold water in a low temperature heat exchanger to absorb heat from a combustor of the high temperature section of the Vuilleumier heat pump during heating operation to thereby maintain a predetermined heating coefficient of performance.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Hereinafter, a preferred embodiment of the cooling and heating water circulation apparatus of Vuilleumier pump invention according to the present invention will be described in detail with reference to the accompanying drawings.

Figure 1:
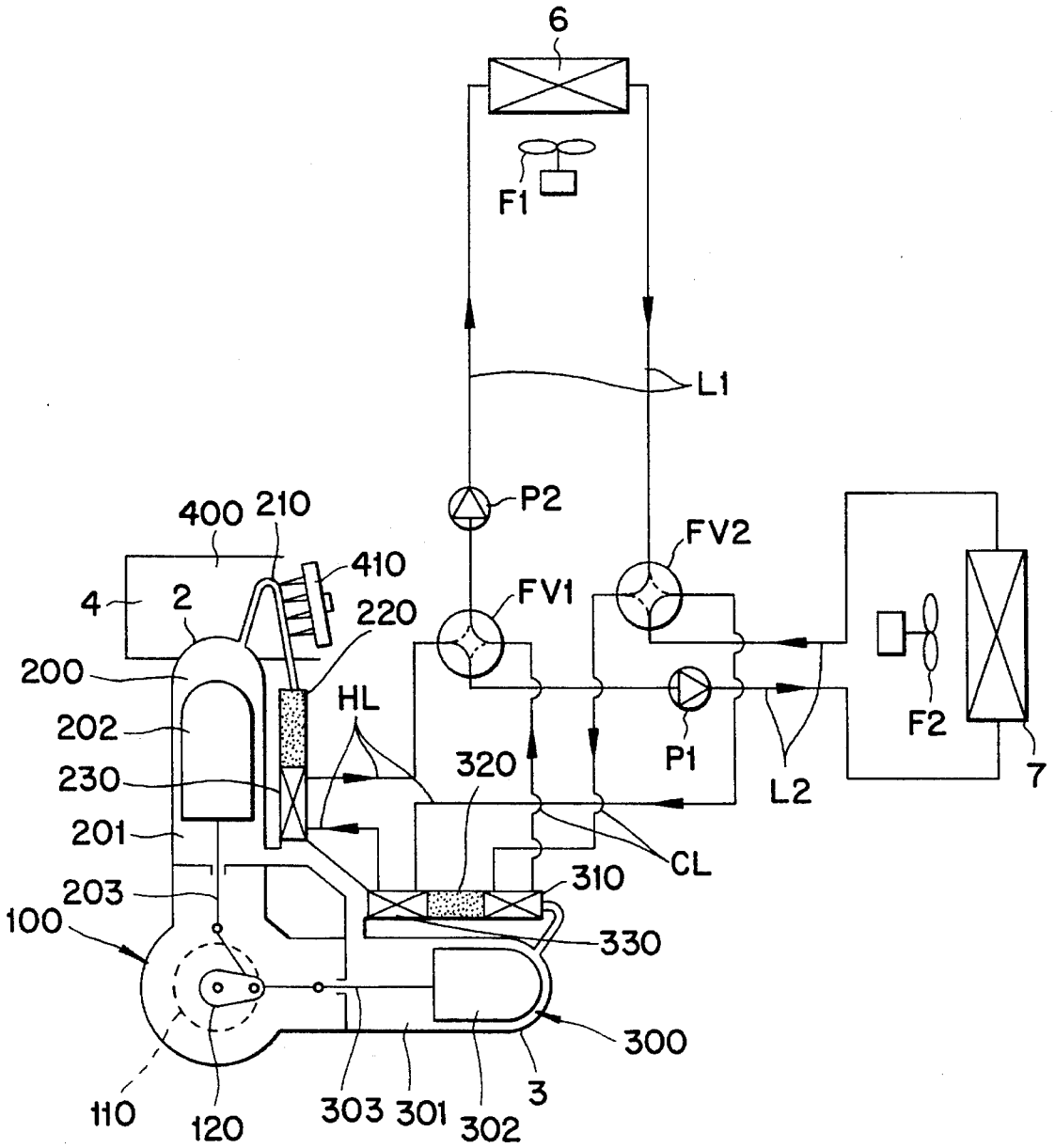
FIG. 1 (PRIOR ART)
FIG.1 is a schematic view of a cooling and heating water circulation apparatus of Vuilleumier heat pump according to the prior art.
Figure 2:
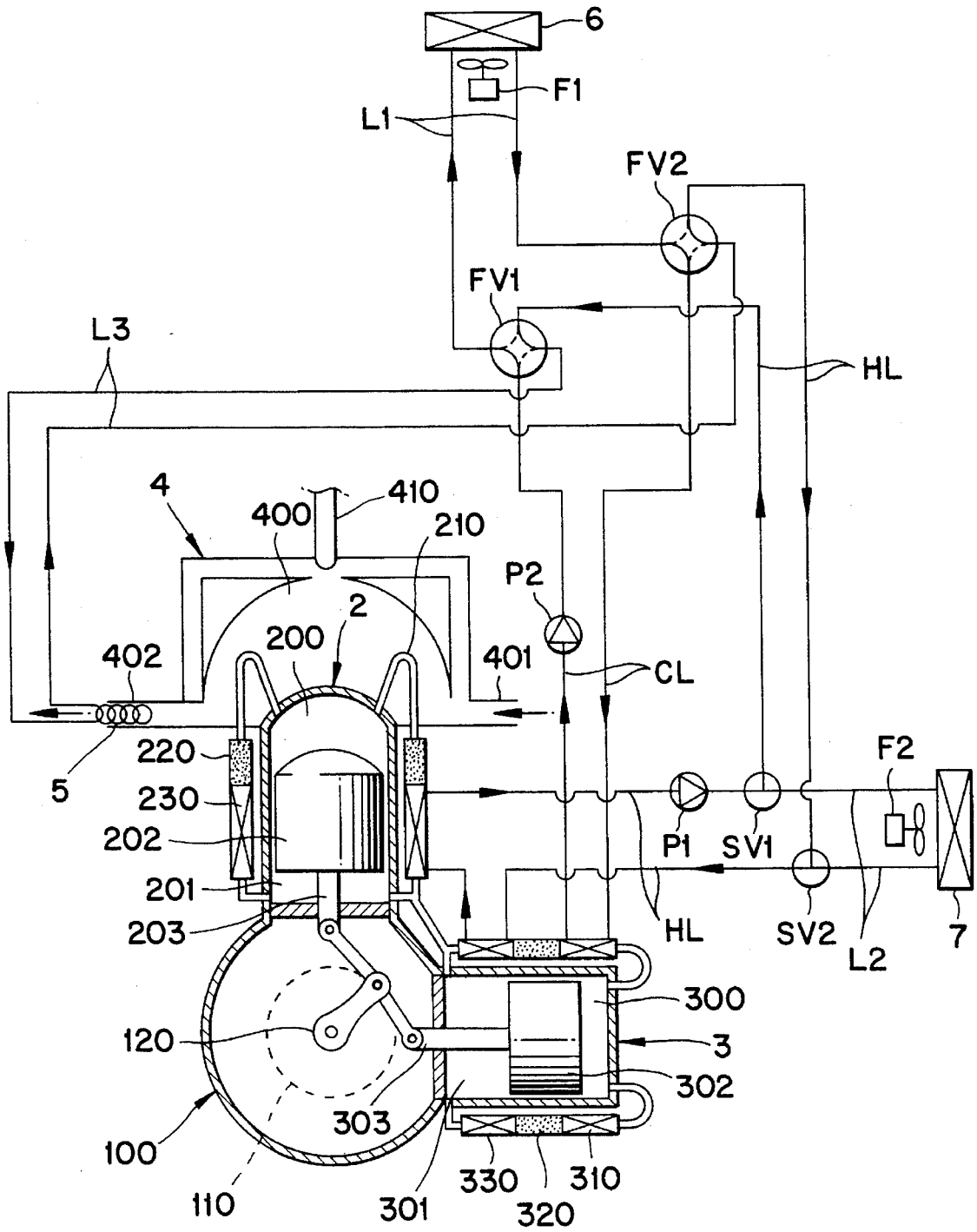
FIG. 2 is a schematic view of a cooling and heating water circulation apparatus of Vuilleumier heat pump according to the present invention.

FIG. 2 is a system drawing of a cooling and heating water circulation apparatus of Vuilleumier heat pump according to the present invention, the apparatus comprising: cylinders 2, 3 on high temperature and low temperature sides of the pump, respectively; a high temperature displacer 202 and a high temperature displacer 302 disposed in the cylinders 2, 3, respectively; a high temperature chamber 200 and a mid temperature chamber 201 formed on the high temperature side; a mid temperature chamber 301 and a low temperature chamber 300 formed on the low temperature side; a combustion unit 4 having a burner 410 and a combustion chamber 400; a motor 110 for driving a crank shaft 120 connected to connecting rods 203 and 303 of respective displacers 202 and 302; a driving chamber 100 disposed with the motor 110; a high temperature heat exchanger 210, a high temperature regenerator 220 and a mid temperature heat exchanger 230 formed on the high temperature side; and a low temperature heat exchanger 310, a low temperature regenerator 320 and a mid temperature heat exchanger 330 formed on the low temperature side.

Meanwhile, a heating water pipe HL penetrates the mid temperature heat exchanger 230 on the high temperature side and the mid temperature heat exchanger 330 on the low temperature side, and a cooling water pipe CL penetrates the low temperature heat exchanger 310.

Furthermore, an exhaust gas discharging port 402 of the combustion unit 4 is provided with a waste heat exchanger 5 which is connected to an auxiliary water pipe L3.

The heating and cooling water pipes HL and CL and the auxiliary water pipe L3 are connected to an indoor connecting water pipe L1 or an outdoor connecting water pipe L2 by operations of three-way valves SV1 and SV2 and four-way valves FV1 and FV2.

The indoor connecting water pipe L1 is connected to the indoor heat exchanger 6 while the outdoor connecting water pipe L2 is connected to the outdoor heat exchanger 7.

In other words, during the heating operation, the heating water pipe HL is connected to the indoor heat exchanger 6 through the indoor connecting water pipe L1 according to operations of the three-way valves SV1 and SV2 and the four-way valves FV1 and FV2, and the cooling water pipe CL is connected to the waste heat exchanger 5 through the auxiliary water pipe L3.

During the cooling operation, according to the operations of the three-way valves SV1 and SV2 and the four-way valve FV1 and FV2, the heating water pipe HL is connected to the outdoor heat exchanger 7 through the outdoor connecting water pipe L2, and the cooling water pipe CL is connected to the indoor heat exchanger 6 through the indoor connecting water pipe L1.

Meanwhile, the waste heat exchanger 5 is disposed at a predetermined place of the exhaust gas discharge port 402 to thereby obtain an appropriate heating COP and to prevent the heat exchanger 5 from being overheated as well.

In other words, in order to maintain temperature in the low temperature chamber 300 at 5 degrees below zero celsius, the waste heat exchanger 5 is disposed at the exhaust gas discharge port 402 where temperature of the exhaust gas is over 10 degrees celsius.

At this time, the waste heat exchanger 5 passes the combustion unit connecting water pipe L3 where the cooling water flows through the exhaust gas discharge port 402 to allow the heat exchange to be executed.

It is desirable that the combustion unit connecting water pipe L3 should be rotated around the exhaust gas discharge port 402 to thereby allow the cooling water flowing through the water pipe L3 to fully absorb the necessary heat.

Reference numeral 401 denotes a combustion air supply port of the combustion unit 4, and P1 and P2 denote circulation pumps for cooling and heating water.

In the cooling and heating water circulation apparatus of the Vuilleumier heap pump thus constructed according to the present invention, the cooling water pipe CL passing through the low temperature heat exchanger 310 operated by way of the four-way valves FV1 and FV2 is connected to the indoor connecting water pipe L1 during the cooling operation while the combustion unit connecting water pipe L3 is in turn disconnected.

By way of operations of the three-way valves SV1 and SV2, the heating water pipe HL is connected to the outdoor connecting water pipe L2.

When the Vuilleumier heat pump is operated under these circumstances, the cooling water cooled by passing through the low temperature heat exchanger 310 is circulated to the indoor heat exchanger 6 through the cooling water pipe CL and the indoor connecting water pipe L1 to thereby perform the cooling operation.

At the same time, the heating water heated by passing through the mid temperature heat exchangers 230 and 330 on the high temperature and mid temperature sides is circulated to the outdoor heat exchanger 7 through the heating water pipe HL and the outdoor connecting water pipe L2 to thereby form a general cooling cycle in accordance with the radiant heat.

Meanwhile, during the heating operation the heating water pipe HL is connected to the indoor connecting water pipe L1 by way of operations of the four-way valves FV1 and FV2, while the cooling water pipe CL is connected to the combustion unit connecting water pipe L3.

At this time, the connection between the heating water pipe HL and the outdoor connecting water pipe L2 is disconnected by way of the operations of the three-way valves SV1 and SV2.

Accordingly, the heating water which has passed the heat exchangers 230 and 330 on the high and low temperature sides is circulated to the indoor heat exchanger 6 through the heating water pipe L1 and the indoor connecting water pipe L1 to thereby perform the heating process.

At the same time, the cooling water cooled by passing through the low temperature heat exchanger 310 is circulated to the waste heat exchanger 5 through the cooling water pipe CL and the combustion unit connecting pipe L3 to thereby absorb the waste heat and to form a heating cycle.

As seen from the foregoing, because the cooling water passing through the low temperature heat exchanger 310 absorbs a predetermined amount of heat from the combustion unit 4 when circulating through the waste heat exchanger 5, the temperature in the low temperature chamber 300 is maintained at an appropriate level, to thereby improve the heating COP.

In other words, because the cooling water in the low temperature heat exchanger 310 is not circulated to the outdoor heat exchanger 7, the heat input of the combustion unit 4 should not be increased markedly during upsurge of heating load resulting from the abrupt drop of the outdoor temperature in winter seasons, so that the heating efficiency can be improved.

By way of example, if the temperature TH in the high temperature chamber is approximately 600 degrees celsius (873 K.), the temperature TA in the mid temperature chamber is 60 degrees celsius (333 K.), and the temperature TC in the low temperature chamber is 5 degrees below zero celsius (268 K.), the cooling COP (COPc) of a conventional system can be calculated by the formula 1.

$$COPc=(TH-TA/TH)\ (TC/TA-TC)=(873-333/873)\ (268/333-268)=2.55$$

The heating COP (COPh) can be calculated by Formula 2 in the following manner.

$$COPh=1+COPc=1+2.55=3.55$$

However, if the temperature TC in the low Temperature chamber is increased to 5 degrees celsius (278 K.) by way of retrieval of heat from the waste heat exchanger 5 according to the present invention, the cooling COP (COPc) can be calculated by the Formula 1 in the following way.

$$COPc-(TH-TA/TH)\ (TC/TA-TC)=(873-333/873)\ (278/333-278)=3.13$$

Now, the heating COP (COPh) can be calculated by Formula 2 in the following method.

$$COPh=1+COPc=1+3.13=4.13$$

As seen from the foregoing, according to the present invention, because the low temperature heat exchanger 310 absorbs the heat, not from the outdoors, but from the combustion unit 4 during the heating operation, the temperature in the low temperature chamber 300 is not affected by the outdoor temperature, preventing the heating COP from being reduced in accordance with the outdoor temperature changes and thereby improving the heating efficiency.

The invention is not restricted to the above-described examples. In practice, still many other variations and modifications are possible without departing from the spirit and the scope of present invention.

Specifically, although the foregoing description of the preferred embodiment has only explained about a case where the heat discharged to the exhaust gas discharge port of the combustion unit is utilized in order to improve the heating COP, it should be noted that the object of present invention can be accomplished even by maintenance of temperature in the low temperature chamber through absorption of heat from any place of the combustion unit.

Furthermore, although the foregoing description and drawings have explained about correlation between the three-way valves and the four-way valves, and the respective connecting water pipes, it should be apparent that in practice many variations are possible to those skilled in the art without departing from the scope of the invention.

In other words, the present invention is not restricted to the aforesaid examples only. The heating COP is increased by absorption of heat from the combustion unit during the heating operation, to thereby improve the heating efficiency.

What is claimed:

1. Apparatus for heating and cooling a room, comprising:

A) an indoor heat exchanger;

B) an outdoor heat exchanger;

C) a Vuilleumier heat pump connected to the indoor and outdoor heat exchangers for supply heat exchange medium thereto, the heat pump comprising:

C1) a housing forming a high temperature section including:

C1a) a high temperature chamber containing heat exchange medium,

C1b) a combustion unit,

C1c) a high temperature heat exchanger connected to the high temperature chamber, and

C1d) a high temperature displacer disposed in the high temperature chamber for displacing the heat exchange medium therein,

C2) a housing forming a low temperature section including:

C2a) a low temperature chamber containing heat exchange medium,

C2b) a low temperature heat exchanger connected to the low temperature chamber, and

C2c) a low temperature displacer disposed in the low temperature chamber for displacing the heat exchange medium therein,

C3) a motor connected to the high and low temperature displacers for reciprocating the high and low temperature displacers within their respective chambers, and

C4) an auxiliary heat exchanger arranged for absorbing heat from the combustion unit; and D) valves operable during a room-heating mode for connecting the high temperature heat exchanger in heat exchanging relationship with the indoor heat exchanger, and for connecting the low temperature heat exchanger in heat exchanging relationship with the auxiliary heat exchanger so that heat exchange medium traveling between the low temperature heat exchanger and the auxiliary heat exchanger is heated by the latter.

2. The apparatus according to claim 1 further including a first pump for circulating heat exchange medium between the high temperature heat exchanger and the indoor heat exchanger, and a second pump for circulating a heat exchange medium between the auxiliary heat exchanger and the low temperature heat exchanger during the heating mode.

3. The apparatus according to claim 1, wherein the combustion unit includes a gas exhaust port, the auxiliary heat exchanger arranged in heat exchanging relationship with exhaust gas exiting the gas exhaust port.

4. The apparatus according to claim 1, wherein the valves comprise two four-way valves for connecting the low temperature heat exchanger selectively with the indoor heat exchanger and the auxiliary heat exchanger, and two three-way valves for connecting the high temperature heat exchanger selectively with the indoor heat exchanger and an outdoor heat exchanger.

5. The apparatus according to claim 1, wherein the high temperature heat exchanger is arranged to exchange heat with the combustion unit.

6. The apparatus according to claim 5, wherein the heat exchange medium in the high and low temperature chambers is a gas.

* * * * *